US010749269B2

(12) United States Patent
Minami

(10) Patent No.: US 10,749,269 B2
(45) Date of Patent: Aug. 18, 2020

(54) ARRAY ANTENNA

(71) Applicant: TOYOTA JIDOSHA KABUSHIKI KAISHA, Toyota-shi, Aichi-ken (JP)

(72) Inventor: Yoshiaki Minami, Gotemba (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 16/287,221

(22) Filed: Feb. 27, 2019

(65) Prior Publication Data

US 2019/0267719 A1 Aug. 29, 2019

(30) Foreign Application Priority Data

Feb. 28, 2018 (JP) ..... 2018-035175

(51) Int. Cl.

*H01Q 21/08* (2006.01)
*H01Q 21/00* (2006.01)
*H01Q 21/22* (2006.01)

(52) U.S. Cl.

CPC ..... *H01Q 21/08* (2013.01); *H01Q 21/0006* (2013.01); *H01Q 21/22* (2013.01)

(58) Field of Classification Search

CPC .... H01Q 21/06; H01Q 21/08; H01Q 21/0037; H01Q 21/12; H01Q 21/0006; H01Q 11/02; H01Q 19/30; H01Q 21/22; H01Q 21/30

See application file for complete search history.

(56) References Cited

U.S. PATENT DOCUMENTS

2010/0253587 A1* 10/2010 Lindenmeier ..... H01Q 7/00 343/797

FOREIGN PATENT DOCUMENTS

JP 2001-111330 A 4/2001
JP 2015-010823 A 1/2015

* cited by examiner

*Primary Examiner* — Jimmy T Vu

(74) *Attorney, Agent, or Firm* — Sughrue Mion, PLLC

(57) ABSTRACT

An array antenna is provided with a feeding line including a first branch line and a second branch line, and a coupling line. Radiating elements provided for the first branch line are disposed on one side of the first branch line. Radiating elements provided for the second branch line are disposed on a side of the second branch line that is opposite to the one side. A distance from a coupling part, in which the first and second branch lines couples with the coupling line, to a radiating element that is closest to the coupling part out of the plurality of radiating elements provided for the first branch line is greater than a distance from the coupling part to a radiating element that is closest to the coupling part out of the plurality of radiating elements provided for the second branch line, by $(2n-1)\lambda/2$ in electrical length.

6 Claims, 5 Drawing Sheets

ARRAY ANTENNA

CROSS-REFERENCE TO RELATED APPLICATIONS

This application is based upon and claims the benefit of priority of the prior Japanese Patent Application No. 2018-035175, filed on Feb. 28, 2018, the entire contents of which are incorporated herein by reference.

BACKGROUND

1. Technical Field

Embodiments of the present disclosure relate to an array antenna.

2. Description of the Related Art

For this type of antenna, for example, there is proposed a planar array antenna having a feeding strip line, which linearly extends, and a plurality of radiating antenna elements, which project perpendicularly from the line (refer to Japanese Patent Application Laid Open No. 2001-111330 (Patent Literature 1)). There is also proposed a technology/technique in which an auxiliary antenna is formed from two element antennas, which are disposed apart a predetermined distance from each other on the same plane that is perpendicular to a main lobe direction of a main antenna, and in which high frequency signals from the element antennas are combined with the same amplitude and in opposite phase at a frequency to be received (refer to Japanese Patent Application Laid Open No. 2015-010823 (Patent Literature 2)).

In this type of antenna, a beam width and directivity are used as an index indicating the performance of the antenna. In the technologies/techniques disclosed in the Patent Literatures 1 and 2, however, it is hard to design the antenna in such a manner that the beam width and the directivity have a desired width and desired directivity, which is technically problematic.

SUMMARY

In view of the aforementioned problems, it is therefore an object of embodiments of the present disclosure to provide an array antenna that can realize the desired beam width and the desired directivity, relatively easily.

The above object of embodiments of the present disclosure can be achieved by an array antenna provided with a feeding line, which includes: a first branch line and a second branch line, each of which extends in one direction and each of which includes a plurality of radiating elements; and a coupling line configured to couple or combine the first branch line and the second branch line, wherein the plurality of radiating elements provided for the first branch line are disposed on one side of the first branch line, the plurality of radiating elements provided for the second branch line are disposed on a side of the second branch line that is opposite to the one side, and a distance from a coupling part, in which the first and second branch lines couples with the coupling line, to a radiating element that is closest to the coupling part out of the plurality of radiating elements provided for the first branch line is greater than a distance from the coupling part to a radiating element that is closest to the coupling part out of the plurality of radiating elements provided for the second branch line, by $(2n-1)\lambda/2$ in electrical length (wherein $\lambda$ is wavelength and n is a natural number).

DETAILED DESCRIPTION OF THE EMBODIMENTS

An array antenna according to embodiments of the present disclosure will be explained with reference to the drawings.

First Embodiment

An array antenna according to a first embodiment will be explained with reference to FIG. 1 and FIG. 2.

(Configuration)

An outline of the array antenna according to the first embodiment will be explained with reference to FIG. 1. FIG. 1 is a plan view illustrating the array antenna according to the first embodiment. Illustrations of a dielectric substrate and a bottom board are omitted. The same will apply to FIG. 3A and FIG. 3B, FIG. 4, FIG. 6, FIG. 7, and FIG. 9.

Figure 1:
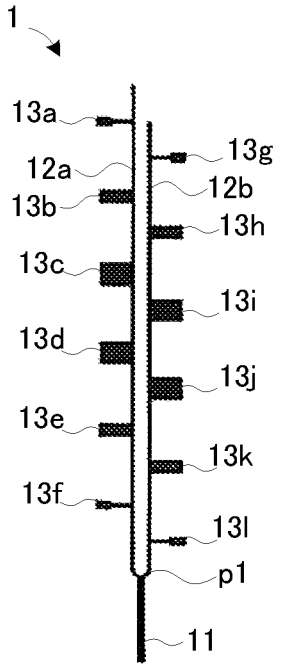
FIG. 1 is a plan view illustrating an array antenna according to a first embodiment.

In FIG. 1, an array antenna 1 is a horizontal polarization array antenna. The array antenna 1 is provided with: branch lines 12*a* and 12*b*, which are adjacent to each other and which extend in one direction (which is a vertical direction on a paper surface); and a coupling line 11 configured to couple or combine the branch lines 12*a* and 12*b*. The coupling line 11 and the branch lines 12*a* and 12*b* constitute a feeding line of the array antenna 1. In the first embodiment, the "branch lines 12*a* and 12*b*, which are adjacent to each other" may preferably mean the "branch lines 12*a* and 12*b*, which are adjacent to each other without interposing another feeding line (or branch line) therebetween".

The branch line 12*a* is provided with a plurality of radiating elements 13*a*, 13*b*, 13*c*, 13*d*, 13*e* and 13*f*, which dendritically project in a direction that crosses the one direction, and on the opposite side of the branch line 12*b*. In the same manner, the branch line 12*b* is provided with a plurality of radiating elements 13*g*, 13*h*, 13*i*, 13*j*, 13*k* and 131, which dendritically project in the direction that crosses the one direction, and on the opposite side of the branch line 12*a*. Particularly in the first embodiment, the array antenna 1 is configured in such a manner that a distance from a coupling part p1, in which the branch lines 12*a* and 12*b* couples with the coupling line 11, to the radiating element 13*f* is greater than a distance from the coupling part p1 to the radiating element 131 by $(2n-1)\lambda/2$ in electrical length (wherein n is a natural number). The "electrical length" is a length based on an electrical phase change amount, and a length in which the phase changes by 360 degrees is equivalent to one wavelength.

In each of the branch lines 12*a* and 12*b*, a standing wave is generated from an electric power directed from the coupling part p1 to a reflection end (hereinafter referred to as a "traveling wave") and from an electric power directed from the reflection end to the coupling part p1 (hereinafter referred to as a "reflected wave"). The radiating elements 13*a*, 13*b*, 13*c*, 13*d*, 13*e* and 13*f* are respectively disposed in parts corresponding to the nodes of the standing wave generated in the branch line 12*a*. In the same manner, the radiating elements 13*g*, 13*h*, 13*i*, 13*j*, 13*k* and 131 are respectively disposed in parts corresponding to the nodes of the standing wave generated in the branch line 12*b*.

A part of an electric power inputted to the coupling line 11 may be successively coupled with and radiated or emitted from each of the radiating elements 13*a*, 13*b*, 13*c*, 13*d*, 13*e* and 13*f* via the branch line 12*a*; namely, an electric wave or a radio wave may be radiated from each radiating element. Moreover, the other part of the electric power inputted to the coupling line 11 may be successively coupled with and radiated from each of the radiating elements 13*g*, 13*h*, 13*i*, 13*j*, 13*k* and 131 via the branch line 12*b*.

(Beam Width of Array Antenna)

For example, an antenna array of a type disclosed in the Patent Literature 1 is provided with: a feeding line, which is formed on a dielectric substrate and which linearly extends; and a plurality of radiating elements, which are directly connected to the feeding line and which dendritically project. A beam width of the antenna array varies depending on a width between a left radiating element and a right radiating element of the array antenna (e.g., a distance between a center of a radiating element projecting on one side of the feeding line and a center of a radiating element projecting on the opposite side of the one side of the feeding line). Specifically, as the width between the radiating elements is increased, the beam width is narrowed; namely, directivity is improved. On the other hand, as the width between the radiating elements is narrowed, the beam width is increased; namely, the directivity is reduced.

By the way, a propagation speed of an electromagnetic wave in a medium (or a dielectric substance) may be determined by a dielectric constant and a magnetic permeability of the medium. The dielectric substance has a relative permeability of approximately 1, and the size of the radiating elements formed on the dielectric substrate may be thus determined mainly in accordance with the dielectric constant of the dielectric substrate. Therefore, if the dielectric constant of the dielectric substrate is changed, the size of the radiating elements can be changed. In other words, if the dielectric constant of the dielectric substrate is changed, the width between the radiating elements may be changed, and the beam width can be thus changed.

The dielectric substrate, however, needs to satisfy electrical performance, such as, for example, a dielectric constant and a loss, and mechanical performance, such as, for example, strength and a coefficient of thermal expansion, or the like. It is thus not easy to change materials of the dielectric substrate and a compounding ratio, and it is hard to change the dielectric constant of the dielectric substrate so as to obtain a desired beam width. Therefore, it is also hard to change the size of the radiating elements to obtain a desired beam width.

The array antenna 1 is provided with the branch lines 12*a* and 12*b*, as a part of the feeding line. Thus, if a distance is changed between the branch lines 12*a* and 12*b*, it is possible to change the width between the radiating elements described above, without changing the size of the radiating elements 13*a* to 131, i.e., without changing the dielectric constant of the dielectric substrate.

(Characteristics of Array Antenna)

Next, characteristics of the array antenna 1 will be explained with reference to FIG. 2. FIG. 2 is a characteristic diagram illustrating an example of the characteristics of the array antenna according to the first embodiment. A solid line in FIG. 2 indicates the characteristics of the array antenna 1 (which is horizontal plane directivity herein). A dotted line in FIG. 2 indicates the characteristics of an array antenna according to a comparative example in which the feeding line is not provided with the branch line (which is, for example, the array antenna of the type disclosed in the Patent Literature 1).

Figure 2:
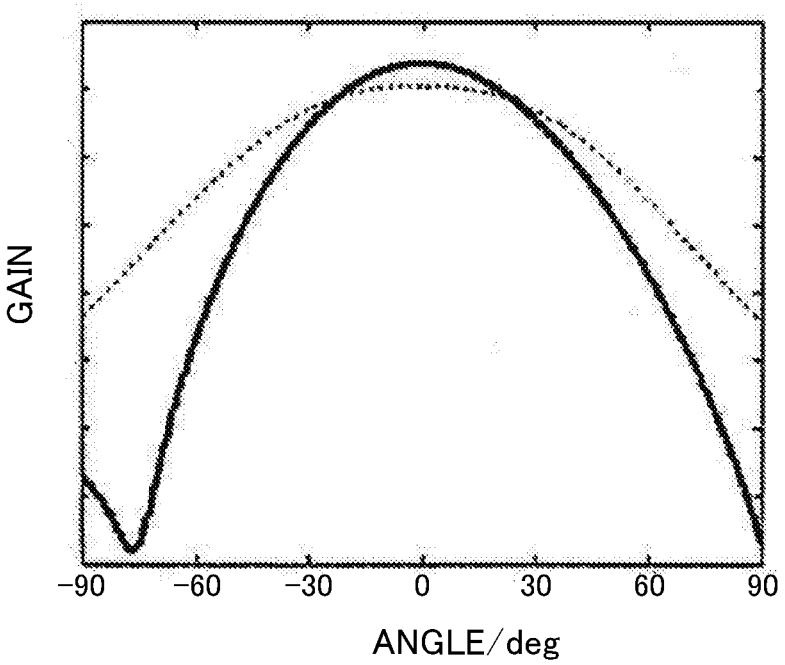
FIG. 2 is a characteristic diagram illustrating an example of characteristics of the array antenna according to the first embodiment.

In FIG. 2, near 0 degrees C., the gain of the array antenna 1 (refer to the solid line) is greater than the gain of the array antenna according to the comparative example (refer to the dotted line). On the other hand, in an area with a relatively large angle, the gain of the array antenna 1 is significantly less than the gain of the array antenna according to the comparative example. In other words, it can be said that the array antenna 1 has a narrowed beam width or improved directivity, in comparison with the array antenna according to the comparative example.

In FIG. 2, left-right asymmetric characteristics of the array antenna 1, which is indicated by the solid line, is supposedly caused by a difference in an excitation distribution between the left and right radiating elements, in addition to a vertical offset of the left and right radiating elements.

(Technical Effect)

According to the array antenna 1, it is possible to realize the desired beam width and the desired directivity without changing the size of the radiating elements 13*a* to 13*l*, by changing the distance between the branch lines 12*a* and 12*b*.

The array antenna is sometimes used for, for example, an on-vehicle radar. When being mounted on a vehicle, the radar is disposed, for example, on an emblem, on a bumper, on the back side of a resin cover, or the like, in many cases. Here, the electromagnetic wave has different transmission characteristics in a resin material, depending on its polarized wave. Specifically, if the resin material has a relatively small slope (i.e., if the resin material stands approximately vertical to the ground), a horizontally polarized wave has less transmission attenuation in a wide-angle direction on a horizontal plane in comparison with a vertically polarized wave, which is a known fact. Meanwhile, the horizontal polarization array antenna tends to radiate the electromagnetic wave in a lateral direction, and this causes a disturbance of a directivity pattern, which is problematic.

The array antenna 1, however, can realize the desired beam width by changing the distance between the branch lines 12*a* and 12*b*, even though it is the horizontal polarization array antenna, and the array antenna 1 can improve the disturbance of the directivity pattern by reducing the radiation of the electromagnetic wave in the lateral direction. Thus, according to the array antenna 1, it is possible to realize an on-vehicle radar that uses a horizontally polarized wave, which has excellent transmission characteristics in a resin material located on the front of the on-vehicle radar.

MODIFIED EXAMPLES

Figure 3A:
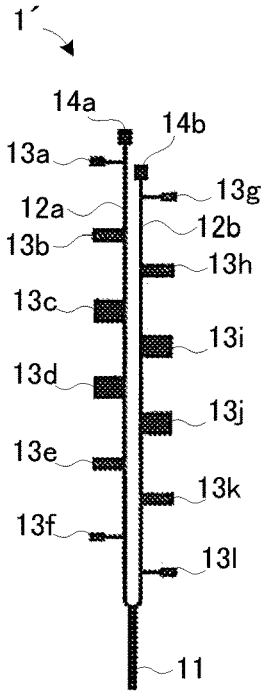
FIG. 3A is a plan view illustrating an array antenna according to a modified example of the first embodiment.
Figure 3B:
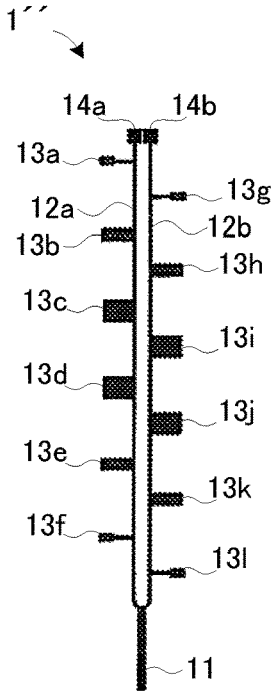
FIG. 3B is a plan view illustrating an array antenna according to a modified example of the first embodiment.

Modified examples of the array antenna 1 according to the first embodiment will be explained with reference to FIG. 3A and FIG. 3B. FIG. 3A and FIG. 3B are plan views illustrating array antennas according to modified examples of the first embodiment.

In FIG. 3A, an array antenna 1' is formed in such a manner that a width of a part 14*a* is greater than a width of the other part of the branch line 12*a* and that a width of a part 14*b* is greater than a width of the other part of the branch line 12*b*, wherein each of the parts 14*a* and 14*b* occupies an area of respective one of the branch lines 12*a* and 12*b* which starts from the reflection end and which has a length corresponding to A14 in electrical length. By such a configuration, it is possible to suppress an electric power amount radiated from the reflection end of each of the branch lines 12*a* and 12*b*.

Moreover, as illustrated in FIG. 3B, the array antenna 1' may be formed in such a manner that the branch lines 12*a* and 12*b* have the same length (or that the reflection ends are located on the same level).

Second Embodiment

An array antenna according to a second embodiment will be explained with reference to FIG. 4 and FIG. 5. The second embodiment is partially different in the shape of the array antenna, but is the same as the first embodiment in the other part. Thus, in the second embodiment, the same explanation as that of the first embodiment will be omitted, and the same parts will carry the same reference numerals on the drawings. A basically different point will be explained with reference to FIG. 4 and FIG. 5.

(Configuration)

An outline of the array antenna according to the second embodiment will be explained with reference to FIG. 4. FIG. 4 is a plan view illustrating the array antenna according to the second embodiment.

Figure 4:
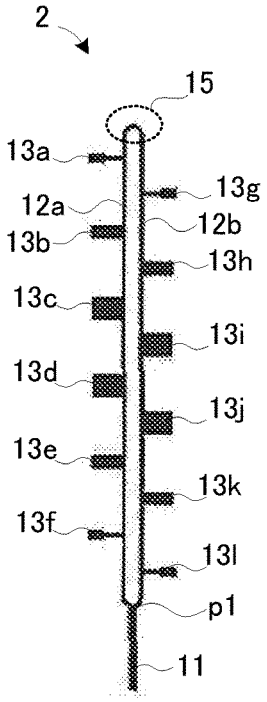
FIG. 4 is a plan view illustrating an array antenna according to a second embodiment.
Figure 5:
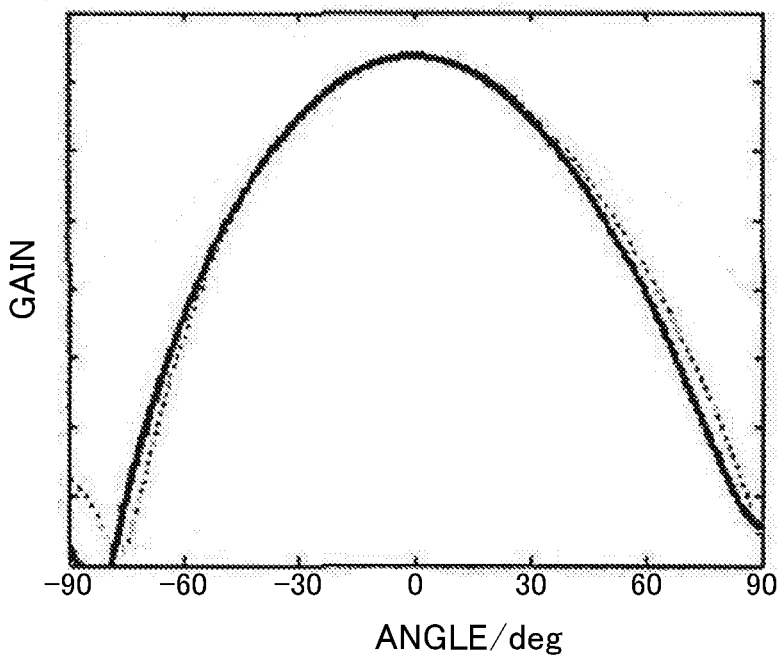
FIG. 5 is a characteristic diagram illustrating an example of characteristics of the array antenna according to the second embodiment.

In FIG. 4, an array antenna 2 is provided with a connecting line 15 configured to connect the branch lines 12*a* and 12*b* on the opposite side of the coupling part 1. The coupling line 11, the branch lines 12*a* and 12*b*, and the connecting line 15 constitute a feeding line of the array antenna 2.

In the array antenna 1 according to the first embodiment, the radiating elements are respectively disposed in the parts corresponding to the nodes of the standing wave that is generated from the traveling wave and the reflected wave. In the array antenna 2 according to the second embodiment, the radiating elements are respectively disposed in parts corresponding to nodes of a standing wave that is generated from a wave associated with an electric power traveling clockwise and a wave associated with an electric power traveling counterclockwise. Hereinafter, the branch lines 12*a* and 12*b*, and the connecting line 15 will be referred to as "an annular line (12*a*, 12*b*, 15)", as occasion demands.

(Characteristics of Array Antenna)

Next, characteristics of the array antenna 2 will be explained with reference to FIG. 5. FIG. 5 is a characteristic diagram illustrating an example of the characteristics of the array antenna according to the second embodiment. A solid line in FIG. 5 indicates the characteristics of the array antenna 2 (which is horizontal plane directivity herein). A dotted line in FIG. 5 indicates the characteristics of the array antenna 1.

In the array antenna 2 (refer to the solid line), the left-right asymmetric characteristics of the horizontal plane directivity is improved in comparison with the array antenna 1 (refer to the dotted line). This may indicate that difference in the excitation distribution between the left and right radiating elements is improved because the left and right feeding lines are annularly connected.

(Technical Effect)

Even in the array antenna 2, it is possible to realize the desired beam width and the desired directivity without changing the size of the radiating elements 13*a* to 131, by changing the distance between the branch lines 12*a* and 12*b*, in other words, by changing flattening of an oval formed by the branch lines 12*a* and 12*b* and the connecting line 15.

Third Embodiment

An array antenna according to a third embodiment will be explained with reference to FIG. 6. The third embodiment is partially different in the shape of the array antenna, but is the same as the second embodiment in the other part. Thus, in the third embodiment, the same explanation as that of the second embodiment will be omitted, and the same parts will carry the same reference numerals on the drawings. A basically different point will be explained with reference to FIG. 6.

(Configuration)

An outline of the array antenna according to the third embodiment will be explained with reference to FIG. 6. FIG. 6 is a plan view illustrating the array antenna according to the third embodiment.

Figure 6:
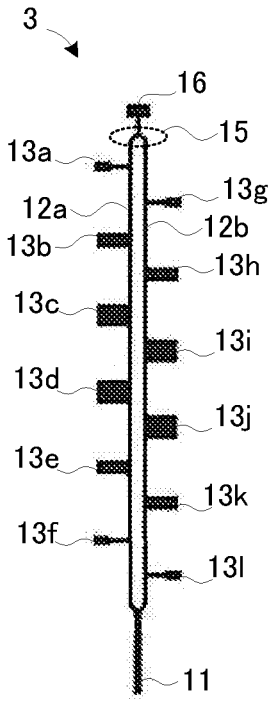
FIG. 6 is a plan view illustrating an array antenna according to a third embodiment.

In FIG. 6, an array antenna 3 is provided with a stub 16, which is connected to the connecting line 15 and which has the same function as that of a A14 short-circuited (short) stub. The stub 16 may be a stub that is short-circuited between the stub 16 and the bottom board by using a via (or a through hole), or may be a stun that functions equally to a short-circuited sub without using a via. In FIG. 6, a T-shape stub is illustrated as an example of the stub 16 having the same function as that of the A14 short-circuited stub. In the T-shape stub, a line with A14 in electrical length extends from the connecting line 15, and a land having a size that allows the connecting line to be equivalently short-circuited is connected to the end. The stub 16, however, is not limited to the T-shape stub, but the existing various aspects can be applied thereto. From a viewpoint of production of the array antenna 3, the stub 16 may be desirably a via-less stub.

(Technical Effect)

In a bend of the feeding line, such as the connecting line 15, the electric power tends to be unnecessarily radiated. The unnecessary radiation of the electric power is more significant with reducing radius of curvature of the bend part, and could be a cause for disturbance of the directivity. According to the array antenna 3, it is possible to prevent the unnecessary radiation of the electric power, which comes from the connecting line 15, by connecting the stub 16 to the connecting line 15.

Fourth Embodiment

An array antenna according to a fourth embodiment will be explained with reference to FIG. 7 and FIG. 8A to FIG. 8C. The fourth embodiment is partially different in the shape of the array antenna, but is the same as the third embodiment in the other part. Thus, in the fourth embodiment, the same explanation as that of the third embodiment will be omitted, and the same parts will carry the same reference numerals on the drawings. A basically different point will be explained with reference to FIG. 7 and FIG. 8A to FIG. 8C.

(Configuration)

Figure 7:
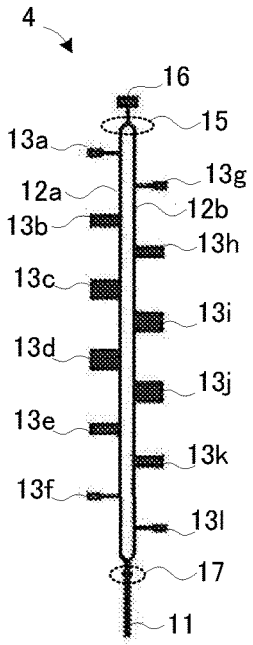
FIG. 7 is a plan view illustrating an array antenna according to a fourth embodiment.

An outline of the array antenna according to the fourth embodiment will be explained with reference to FIG. 7. FIG. 7 is a plan view illustrating the array antenna according to the fourth embodiment.

In FIG. 7, an array antenna 4 is provided with a stub 17 for impedance matching, which is connected to the coupling line 11. The existing various aspects can be applied to an impedance matching method, and an explanation of the details will be thus omitted. An arrangement position and size of the stub 17 may vary depending on impedance of the array antenna 4.

(Technical Effect)

Figure 8A:
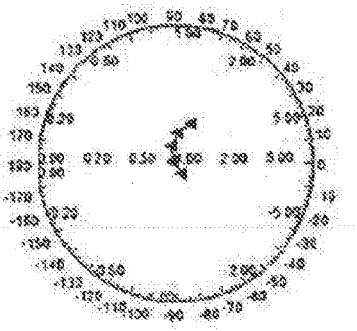
FIG. 8A is a characteristic diagram illustrating an example of characteristics of the array antenna according to the second embodiment.
Figure 8A:
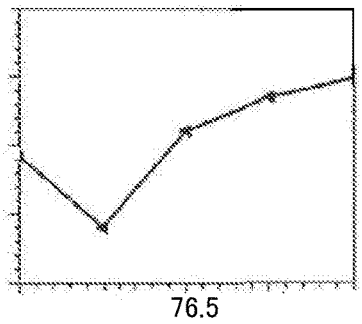
Figure 8B:
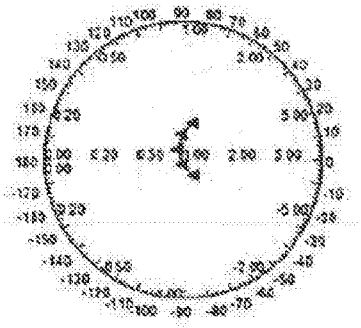
FIG. 8B is a characteristic diagram illustrating an example of characteristics of the array antenna according to the third embodiment.
Figure 8B:
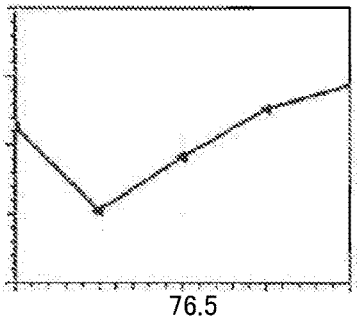
Figure 8C:
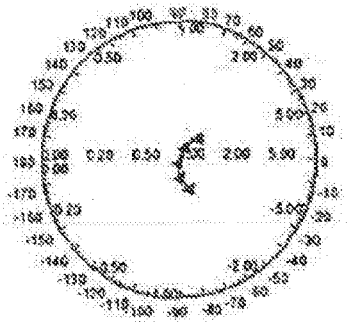
FIG. 8C is a characteristic diagram illustrating an example of characteristics of the array antenna according to the fourth embodiment.
Figure 8C:
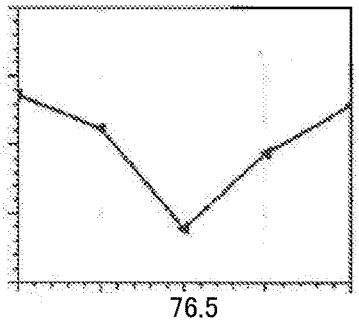

An influence of the annular line (12*a*, 12*b*, 15) of each of the array antennas 2, 3, and 4 on the array antenna will be explained with reference to FIG. 8A to FIG. 8C. FIG. 8A to FIG. 8C are respectively characteristic diagrams illustrating examples of characteristics of the array antennas according to the second to fourth embodiment. An upper part in FIG. 8A to FIG. 8C is a Smith chart. A lower part in FIG. 8A to FIG. 8C is a graph indicating a relation between frequency and return loss (or reflection coefficient). FIG. 8A is a Smith chart and a graph indicating the relation between frequency and return loss for the array antenna 2 according to the second embodiment. FIG. 8B is a Smith chart and a graph indicating the relation between frequency and return loss for the array antenna 3 according to the third embodiment. FIG. 8C is a Smith chart and a graph indicating the relation between frequency and return loss for the array antenna 4 according to the fourth embodiment.

In the array antenna 2, mainly, a reactance component is changed by the annular line (12*a*, 12*b*, 15) to cause a deviation of the impedance, and as illustrated in FIG. 8A, a frequency that allows a small return loss is shifted from a desired frequency (which is 76.5 gigahertz (GHz) here). The stub 16 is not designed to change reactance of the annular line (12*a*, 12*b*, 15) of the array antenna 3. Thus, even in the array antenna 3 provided with the stub 16, as illustrated in FIG. 8B, the frequency that allows a small return loss is still shifted from the desired frequency.

In the array antenna 4 provided with the stub 17 for impedance matching, the deviation of the impedance caused by the annual line (12*a*, 12*b*, 15) is eliminated, and as illustrated in FIG. 8C, the return loss at the desired frequency can be reduced. The stub 17 for impedance matching may be also provided for the array antenna 1 according to the first embodiment.

Fifth Embodiment

Array antennas according to a fifth embodiment will be explained with reference to FIG. 9A, FIG. 9B, and FIG. 10. The fifth embodiment is partially different in the shape of the array antenna, but is the same as the first embodiment in the other part. Thus, in the fifth embodiment, the same explanation as that of the first embodiment will be omitted, and the same parts will carry the same reference numerals on the drawings. A basically different point will be explained with reference to FIG. 9A, FIG. 9B, and FIG. 10.

(Configuration)

An outline of the array antennas according to the fifth embodiment will be explained with reference to FIG. 9A and FIG. 9B. FIG. 9A and FIG. 9B are plan views illustrating the array antennas according to the fifth embodiment.

Figure 9A:
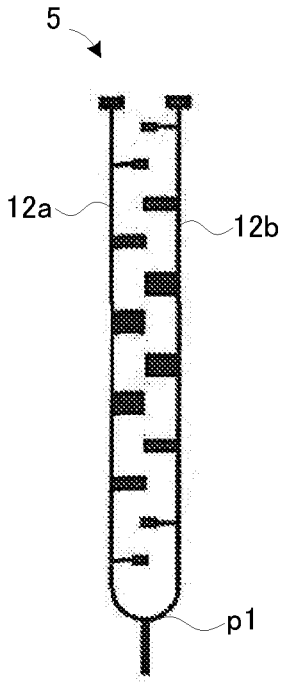
FIG. 9A is a plan view illustrating an array antenna according to a fifth embodiment.
Figure 9B:
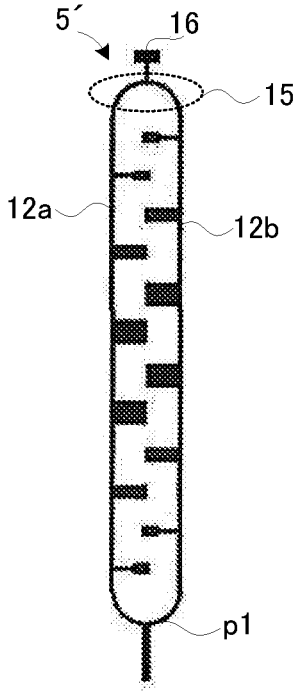
FIG. 9B is a plan view illustrating an array antenna according to the fifth embodiment.

In FIG. 9A, the branch line 12*a* of an array antenna 5 is provided with a plurality of radiating elements, which dendritically project in a direction that crosses one direction (which is a vertical direction on a paper surface), and on the side of the branch line 12*b*. In the same manner, the branch line 12*b* is provided with a plurality of radiating elements, which dendritically project in the direction that crosses the one direction, and on the side of the branch line 12*a*.

In the array antenna 5, reflections ends of the branch lines 12*a* and 12*b* are formed to be wider than the other part; however, the shape of the reflection ends is not limited to this example. Moreover, the other side of the coupling part p1 of the branch lines 12*a* and 12*b* may be connected by the connecting line 15, as illustrated in FIG. 9B. An array antenna 5' illustrated in FIG. 9B is provided with, but may not be provided with, the stub 16. The array antenna 5' may be also provided with a stub for impedance matching.

(Characteristics of Array Antenna)

Next, characteristics of the array antenna 5 will be explained with reference to FIG. 10. FIG. 10 is a characteristic diagram illustrating an example of the characteristics of the array antenna according to the fifth embodiment. A solid line in FIG. 10 indicates the characteristics of the array antenna 5 (which is horizontal plane directivity herein). A dotted line in FIG. 10 indicates the characteristics of the array antenna according to the comparative example in which the feeding line is not provided with the branch line (which is, for example, the array antenna of the type disclosed in the Patent Literature 1).

Figure 10:
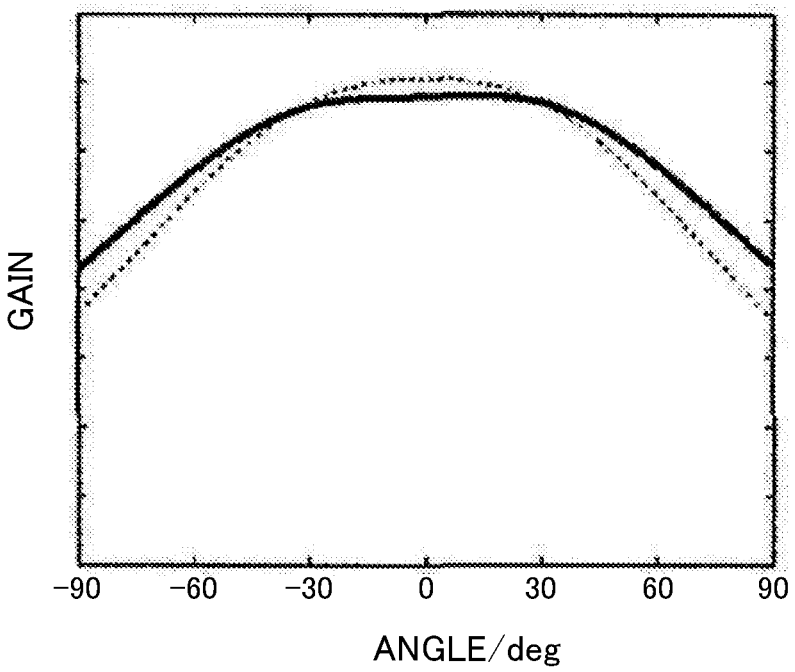
FIG. 10 is a characteristic diagram illustrating an example of characteristics of the array antenna according to the fifth embodiment.

In FIG. 10, near 0 degrees C., the gain of the array antenna 5 (refer to the solid line) is less than the gain of the array antenna according to the comparative example (refer to the dotted line). On the other hand, in an area with a relatively large angle, the gain of the array antenna 5 is greater than the gain of the array antenna according to the comparative example. In other words, it can be said that the array antenna 5 has a wider beam width, in comparison with the array antenna according to the comparative example.

(Technical Effect)

According to the array antennas 5 and 5', it is possible to realize the desired beam width and the desired directivity without changing the size of the radiating elements by changing the distance between the branch lines 12*a* and 12*b*. Various aspects of embodiments of the present disclosure derived from the embodiments and modified examples explained above will be explained hereinafter.

An array antenna according to an aspect of embodiments of the present disclosure is provided with a feeding line, which includes: a first branch line and a second branch line, each of which extends in one direction and each of which includes a plurality of radiating elements; and a coupling line configured to couple or combine the first branch line and the second branch line, wherein the plurality of radiating elements provided for the first branch line are disposed on one side of the first branch line, the plurality of radiating elements provided for the second branch line are disposed on a side of the second branch line that is opposite to the one side, and a distance from a coupling part, in which the first and second branch lines couples with the coupling line, to a radiating element that is closest to the coupling part out of the plurality of radiating elements provided for the first branch line is greater than a distance from the coupling part to a radiating element that is closest to the coupling part out of the plurality of radiating elements provided for the second branch line, by $(2n-1)\lambda/2$ in electrical length (wherein $\lambda$ is wavelength and n is a natural number). In the aforementioned embodiments, the branch lines 12*a* and 12*b* respectively correspond to an example of the first and second branch lines, and the coupling line 11 corresponds to an example of the coupling line.

The beam width and directivity of the array antenna depend on the width between the radiating elements in a direction that crosses an extending direction of the feeding line. A possible method of changing the width between the radiating elements is to change the size of the radiating elements. In order to change the size of the radiating elements, however, it is necessary to change materials of a dielectric substrate on which the array antenna is laid, a compounding ratio, and the like, thereby to change a dielectric constant, which is not realistic.

The array antenna according to the aspect is provided with the first branch line and the second branch line, which are adjacent to each other and each of which extends in the one direction, as a part of the feeding line. A distance between the first and second branch lines can be arbitrarily changed. Thus, according to the array antenna, it is possible to arbitrarily change the width between the radiating elements without changing the size of the radiating elements, by changing the distance between the first and second branch lines. Therefore, according to the array antenna, it is possible to realize the desired beam width and the desired directivity, relatively easily.

In an aspect of the array antenna, the array antenna is provided with a connector configured to connect the first and second branch lines on the opposite side of the coupling part. In the aforementioned embodiments, the connecting line 15 corresponds to an example of the connector. According to this aspect, for example, it is possible to improve left-right symmetry of the horizontal plane directivity associated with the array antenna.

In this aspect, the array antenna may be provided with a stub, which has the same function as that of a $\lambda/4$ short-circuited stub, on the connector. By such a configuration, it is possible to prevent unnecessary radiation of an electric power, which comes from the connector. In the aforementioned embodiments, the stub 16 corresponds to an example of the stub, which has the same function as that of the $\lambda/4$ short-circuited (short) stub.

In another aspect of the array antenna, the coupling line includes a stub for impedance matching. In the aforementioned embodiments, the stub 17 corresponds to an example of the stub for impedance matching. According to this aspect, it is possible to easily match impedance associated with the array antenna.

The present disclosure may be embodied in other specific forms without departing from the spirit or essential characteristics thereof. The present embodiments and examples are therefore to be considered in all respects as illustrative and not restrictive, the scope of the disclosure being indicated by the appended claims rather than by the foregoing description and all changes which come in the meaning and range of equivalency of the claims are therefore intended to be embraced therein.

What is claimed is:

1. An array antenna comprising a feeding line, which includes: a first branch line and a second branch line, each of which extends in one direction and each of which includes a plurality of radiating elements; and a coupling line configured to couple or combine the first branch line and the second branch line, wherein the plurality of radiating elements provided for the first branch line are disposed on one side of the first branch line, the plurality of radiating elements provided for the second branch line are disposed on a side of the second branch line that is opposite to the one side, and a distance from a coupling part, in which the first and second branch lines couples with the coupling line, to a radiating element that is closest to the coupling part out of the plurality of radiating elements provided for the first branch line is greater than a distance from the coupling part to a radiating element that is closest to the coupling part out of the plurality of radiating elements provided for the second branch line, by $(2n-1)\lambda/2$ in electrical length (wherein $\lambda$ is wavelength and n is a natural number).

2. The array antenna according to claim 1, comprising a connector configured to connect the first and second branch lines on the opposite side of the coupling part.

3. The array antenna according to claim 2, comprising a stub, which has the same function as that of a $\lambda/4$ short-circuited stub, on the connector.

4. The array antenna according to claim 1, wherein the coupling line includes a stub for impedance matching.

5. The array antenna according to claim 2, wherein the coupling line includes a stub for impedance matching.

6. The array antenna according to claim 3, wherein the coupling line includes a stub for impedance matching.

* * * * *